US011598321B2

(12) United States Patent
Sommerville

(10) Patent No.: US 11,598,321 B2
(45) Date of Patent: Mar. 7, 2023

(54) HALL-EFFECT THRUSTER

(71) Applicant: ORBION SPACE TECHNOLOGY, INC., Houghton, MI (US)

(72) Inventor: Jason D. Sommerville, Houghton, MI (US)

(73) Assignee: ORBION SPACE TECHNOLOGY, INC., Houghton, MI (US)

( * ) Notice: Subject to any disclaimer, the term of this patent is extended or adjusted under 35 U.S.C. 154(b) by 43 days.

(21) Appl. No.: 17/050,770

(22) PCT Filed: Apr. 2, 2020

(86) PCT No.: PCT/US2020/026420
§ 371 (c)(1),
(2) Date: Oct. 26, 2020

(87) PCT Pub. No.: WO2021/201871
PCT Pub. Date: Oct. 7, 2021

(65) Prior Publication Data

US 2021/0310466 A1 Oct. 7, 2021

(51) Int. Cl.
*F03H 1/00* (2006.01)
*H01J 27/14* (2006.01)

(52) U.S. Cl.
CPC ..... *F03H 1/0075* (2013.01); *F03H 1/0068* (2013.01); *F03H 1/0081* (2013.01); *H01J 27/146* (2013.01)

(58) Field of Classification Search
CPC ..... F03H 1/0062–0075
See application file for complete search history.

(56) References Cited

U.S. PATENT DOCUMENTS 3,572,029 A 3/1971 Swift, Jr.
3,807,657 A 4/1974 Brill
(Continued)

FOREIGN PATENT DOCUMENTS

CN 106828982 A 6/2017
EP 1161855 A1 12/2001
(Continued)

OTHER PUBLICATIONS

International Search Report and Written Opinion mailed in International Patent Application No. PCT/US2020/026420 (dated Jun. 16, 2020).
(Continued)

*Primary Examiner* — Arun Goyal
*Assistant Examiner* — William L Breazeal
(74) *Attorney, Agent, or Firm* — Michael Best & Friedrich LLP

(57) ABSTRACT

A Hall-effect thruster assembly includes a plurality of magnetic sources for creating a magnetic circuit. The plurality of magnetic sources are positioned between a first end and a second, opposite end of the Hall-effect thruster. The plurality of magnetic sources define a longitudinal axis extending through the first end and the second end. The first end is configured as a discharge end. A mount assembly is coupled to the second end. The mount assembly is configured to secure the plurality of magnetic sources to a spacecraft. A magnetic element is supported by the mount assembly. The magnetic element is positioned relative to the plurality of magnetic sources by the mount assembly.

14 Claims, 5 Drawing Sheets

(56) References Cited

U.S. PATENT DOCUMENTS

| | | | | |
|---|---|---|---|---|
| 5,152,169 | A | 10/1992 | Summerfield et al. | |
| 5,763,989 | A | 6/1998 | Kaufman | |
| 5,845,880 | A * | 12/1998 | Petrosov | B64G 1/405 244/169 |
| 6,619,031 | B1 | 9/2003 | Balepin | |
| 6,982,520 | B1 | 1/2006 | de Grys | |
| 7,624,566 | B1 | 12/2009 | Manzella et al. | |
| 9,194,379 | B1 | 11/2015 | Biblarz et al. | |
| 2001/0039832 | A1 | 11/2001 | Sondey | |
| 2002/0145090 | A1 | 10/2002 | Schenk, Jr. | |
| 2002/0145389 | A1 | 10/2002 | Bugrova et al. | |
| 2005/0230557 | A1 | 10/2005 | Aghili | |
| 2006/0076872 | A1 | 4/2006 | De Grys | |
| 2006/0168936 | A1 | 8/2006 | Rooney | |
| 2006/0186837 | A1 | 8/2006 | Hruby et al. | |
| 2006/0290287 | A1 | 12/2006 | Kuninaka | |
| 2007/0018034 | A1 | 1/2007 | Dickau | |
| 2008/0136309 | A1 | 6/2008 | Chu et al. | |
| 2008/0314134 | A1 | 12/2008 | Mainville | |
| 2015/0021439 | A1 | 1/2015 | Duchemin et al. | |
| 2015/0151855 | A1 | 6/2015 | Richards et al. | |
| 2016/0001898 | A1 | 1/2016 | Duchemin et al. | |
| 2016/0273523 | A1 | 9/2016 | King et al. | |
| 2017/0088293 | A1 | 3/2017 | Zurbach et al. | |
| 2017/0210493 | A1 | 7/2017 | Marchandise | |
| 2020/0102100 | A1 * | 4/2020 | Lozano | B64G 1/64 |

FOREIGN PATENT DOCUMENTS

| | | | |
|---|---|---|---|
| ES | 2733773 | A1 | 12/2019 |
| RU | 2377441 | C1 | 12/2009 |
| RU | 2474984 | C1 | 2/2013 |
| RU | 2659009 | C1 | 6/2018 |
| RU | 2738136 | C1 | 12/2020 |
| WO | 02069364 | A2 | 9/2002 |
| WO | 2016181360 | A1 | 11/2016 |
| WO | 2020/005290 | A1 | 1/2020 |

OTHER PUBLICATIONS

International Search Report and Written Opinion for Application No. PCT/US2019/026144 dated Jul. 5, 2019 (12 pages).
International Preliminary Report on Patentability for Application No. PCT/US2019/026144 dated Oct. 15, 2020 (6 pages).
International Search Report and Written Opinion for Application No. PCT/US18/40419 dated Oct. 1, 2018 (11 pages).
International Preliminary Report on Patentability for Application No. PCT/US2018/040419 dated Dec. 29, 2021 (6 pages).
International Search Report and Written Opinion for Application No. PCT/US20/55119 dated Jan. 11, 2021 (15 pages).
Russian Federal Service on Intellectual Property Office Action and Search Report for Application No. 2020140217 dated Dec. 20, 2021 (21 pages including English translation).
International Search Report and Written Opinion for Application No. PCT/US20/55098 dated May 13, 2021 (14 pages).
International Search Report and Written Opinion for Application No. PCT/US20/55063 dated Jul. 1, 2021 (15 pages).

* cited by examiner

HALL-EFFECT THRUSTER

BACKGROUND

The present disclosure relates to Hall-effect thrusters (HETs) for on-orbit spacecraft propulsion, and more particularly to a net magnetic dipole moment generated by the HET.

SUMMARY OF THE INVENTION

The disclosure provides a Hall-effect thruster assembly including a plurality of magnetic sources for creating a magnetic circuit. The plurality of magnetic sources are positioned between a first end and a second, opposite end of the Hall-effect thruster. The plurality of magnetic sources define a longitudinal axis extending through the first end and the second end. The first end is configured as a discharge end. A mount assembly is coupled to the second end. The mount assembly includes a body extending between a first side and a second side. The first side is coupled to the second end of the Hall-effect thruster. The body defines a cavity. The mount assembly further includes a receptacle positioned within the cavity. The mount assembly is further configured to secure the plurality of magnetic sources to a spacecraft. A plurality of discrete magnets are retained at least partially within the receptacle. The plurality of discrete magnets are positioned closer to the second side than the first side of the body. The plurality of discrete magnets are positioned relative to the plurality of magnetic sources by the mount assembly.

The disclosure provides, in another configuration, a Hall-effect thruster assembly including a plurality of magnetic sources for creating a magnetic circuit. The plurality of magnetic sources are positioned between a first end and a second, opposite end of the Hall-effect thruster. The plurality of magnetic sources define a longitudinal axis extending through the first end and the second end. The first end is configured as a discharge end. A mount assembly is coupled to the second end. The mount assembly is configured to secure the plurality of magnetic sources to a spacecraft. A magnetic element is supported by the mount assembly. The magnetic element is positioned relative to the plurality of magnetic sources by the mount assembly.

The disclosure provides, in yet another configuration, a mount assembly for a Hall-effect thruster. The Hall-effect thruster is operable to produce a thrust for spacecraft propulsion. The mount assembly includes a body configured to secure the Hall-effect thruster thereto. The body extends along a longitudinal axis between a first side and a second side. A magnetic element is supported by the body. The mount assembly is couplable to the Hall-effect thruster to position the magnetic element relative to a magnetic field generator for producing the thrust of the Hall-effect thruster.

The disclosure provides, in yet still another configuration, a mount assembly for a Hall-effect thruster. The mount assembly includes a body configured to secure the Hall-effect thruster thereto. The body extends along a longitudinal axis. At least one of a compensating magnetic element or a shield assembly is coupled to the body. The mount assembly is couplable to the Hall-effect thruster to position the at least one of the compensating magnetic element or the shield assembly relative to a plurality of magnetic sources within the Hall-effect thruster. During operation of the Hall-effect thruster, the plurality of magnetic sources create a first magnetic circuit having a magnetic dipole moment. During operation of the Hall-effect thruster, the at least one of the compensating magnetic element or the shield assembly is positioned to reduce an absolute value of the magnetic dipole moment of the Hall-effect thruster by a predetermined percentage in a direction along the longitudinal axis.

The disclosure provides, in another configuration, a Hall-effect thruster assembly including a plurality of magnetic sources for creating a magnetic circuit. The plurality of magnetic sources are positioned between a first end and a second, opposite end of the Hall-effect thruster. The first end is configured as a discharge end. A mount assembly is coupled to the second end. The mount assembly is configured to secure the Hall-effect thruster to a spacecraft. The Hall-effect thruster further includes a structure having a material selected from the group comprising of iron, ferrite, Mu-metal, Hyperco®, or other magnetic material having high permeability. The structure is supported by the mount assembly. The structure is positioned relative to the plurality of magnetic sources by the mount assembly.

The disclosure provides, in yet another configuration, a Hall-effect thruster assembly including a plurality of magnetic sources for creating a magnetic circuit. The plurality of magnetic sources is positioned between a first end and a second, opposite end of the Hall-effect thruster. The plurality of magnetic sources defines a longitudinal axis extending through the first end and the second end. The first end is configured as a discharge end. The magnetic circuit has a non-zero magnetic dipole moment. A mount assembly is coupled to the second end. The mount assembly is configured to secure the Hall-effect thruster to a spacecraft. The mount assembly includes a body having a cavity. A compensating magnetic element is received within the cavity. The compensating magnetic element is selectively positioned relative to the longitudinal axis and configured to reduce an absolute value of the non-zero magnetic dipole moment of the Hall-effect thruster by a predetermined percentage in a direction along the longitudinal axis.

Other aspects of the disclosure will become apparent by consideration of the detailed description and accompanying drawings.

Before any embodiments of the disclosure are explained in detail, it is to be understood that the disclosure is not limited in its application to the details of the formation and arrangement of components set forth in the following description or illustrated in the accompanying drawings. The disclosure is capable of supporting other embodiments and of being practiced or of being carried out in various ways. Also, it is to be understood that the phraseology and terminology used herein is for the purpose of description and should not be regarded as limiting.

DETAILED DESCRIPTION

Figure 1:
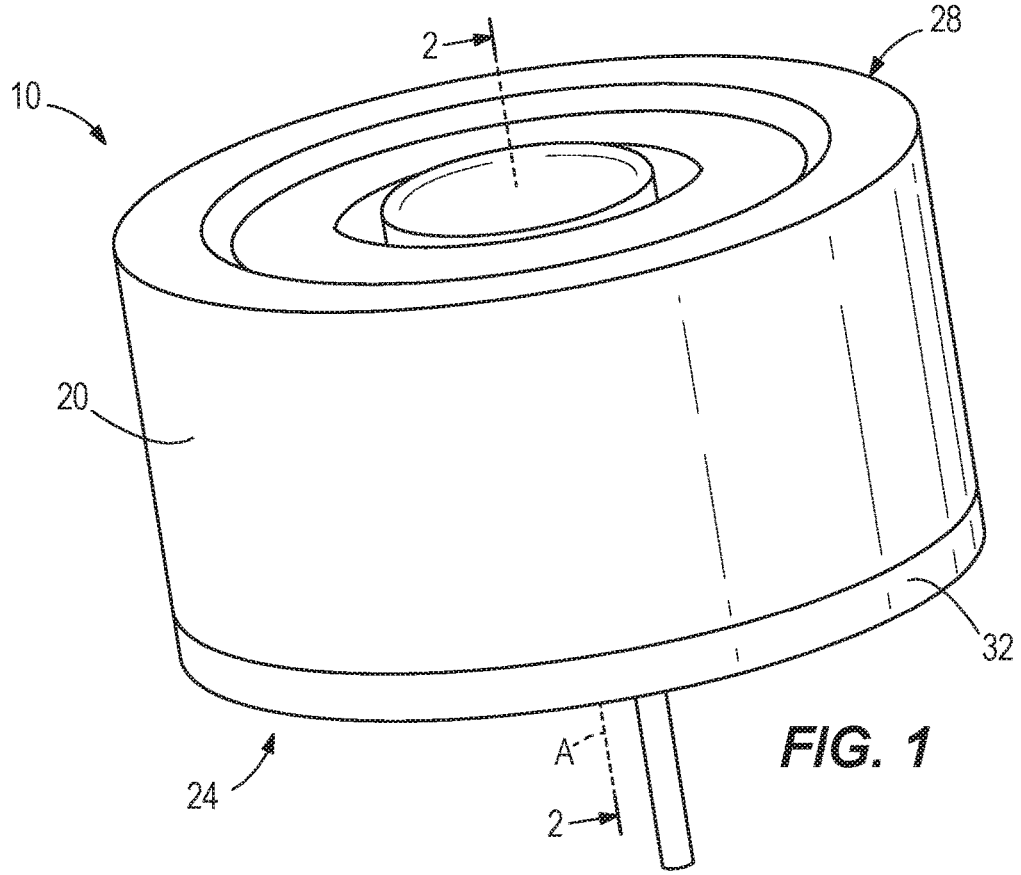
FIG. 1 is an external perspective view of a portion of a conventional HET.
Figure 2:
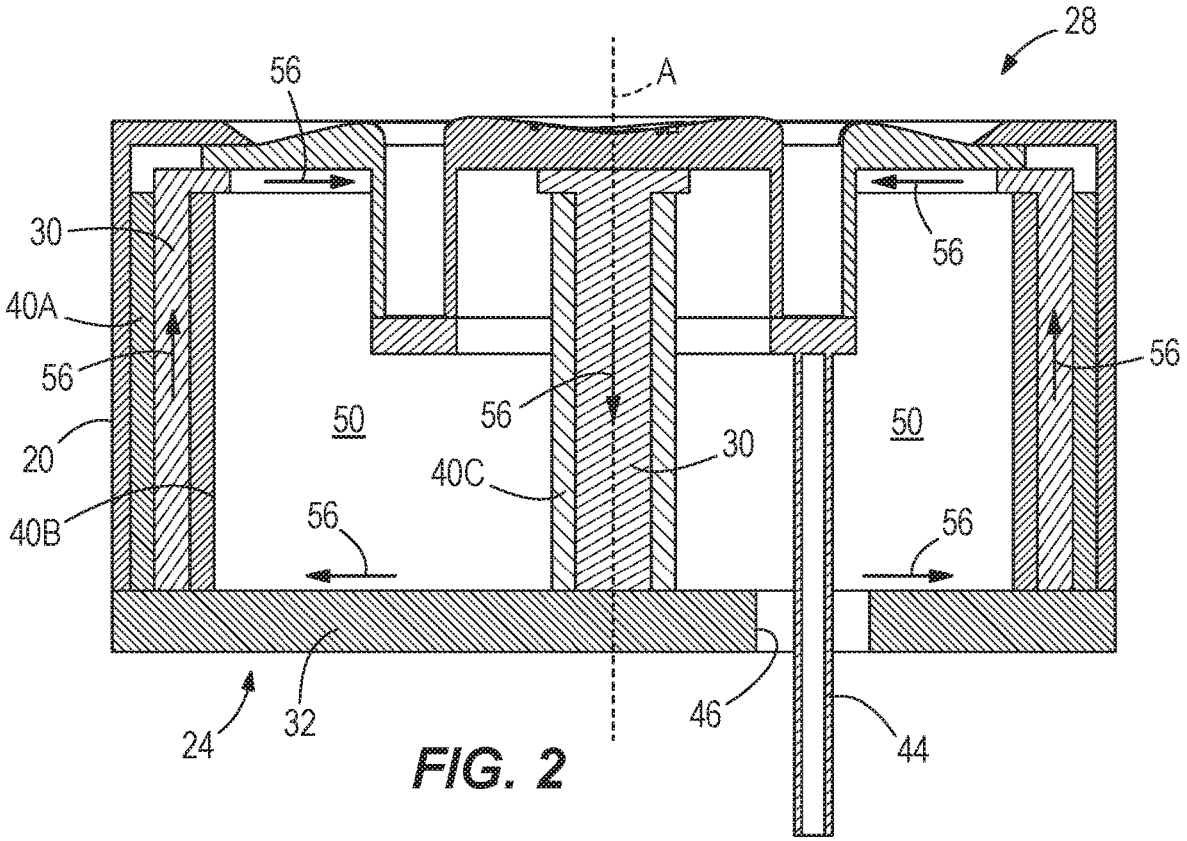
FIG. 2 is a longitudinal schematic cross-sectional view of the conventional HET of FIG. 1 taken along line 2-2 and showing an arrangement of magnetic field sources and magnetic field flux guides.

FIGS. 1 and 2 illustrate a Hall-effect thruster 10 (HET) for spacecraft propulsion. The HET 10 includes a housing 20 having magnetic sources and material positioned therein for creating a magnetic circuit.

Referring to FIG. 2, in a conventional concentric arrangement of magnetic field sources 40A-40C and magnetic field flux guides 30, 32 within the housing 20, a discharge chamber 50 is configured to receive propellant (e.g., Xenon, Krypton, Argon, etc.). More specifically, the propellant is introduced into the discharge chamber 50 through a plurality of tubes 44 extending through respective openings 46 (only one of which is shown in FIG. 2). Voltage applied between a cathode (not shown) positioned at or near a first, discharge end 28 and an anode (not shown) positioned at or near a second end 24 forms an electric field extending axially relative to a longitudinal axis A within the discharge chamber 50. A magnetic circuit (i.e., arrows 56) including magnetic field sources 40A-40C and magnetic field flux guide material 30 is configured to create a radially-oriented magnetic field at the first end 28. Electrons subjected to the magnetic field are used to ionize the propellant. Subsequently, the propellant ions are accelerated by the electric field for generating a thrust at the first end 28. Accordingly, the magnetic field sources 40A-40C and/or the magnetic field flux guides 30, 32 may be termed as a magnetic field generator for producing thrust of a Hall-effect thruster. In other embodiments, the magnetic field generator may represent the elements of a Hall-effect thruster that generate the magnetic field for producing the thrust.

As shown in FIG. 2, the magnetic field sources 40A-40C (e.g., electromagnetic coils or permanent magnets) are oriented such that their magnetic moments are axial relative to the longitudinal axis A from proximate the first end 28 to proximate the second end 24. The illustrated magnetic field sources 40A-40C form generally continuous annular shapes about the longitudinal axis A, but in other embodiments such sources 40A-40C may comprise a plurality of discrete or otherwise spaced sources. In the illustrated embodiment, the HET 10 includes three electromagnetic coils as the magnetic field sources 40A-40C, each positioned relative to the magnetic field flux guide material 30. In other constructions, the magnetic circuit 56 may only include one of the magnetic field sources 40A-40C. Additional magnetic field flux guide material 30 in the form of a plate 32 with high magnetic relative permeability positioned at the second end 24 completes the magnetic circuit 56.

Because of the use of the magnetic field sources 40A-40C (e.g., electromagnetic coils or permanent magnets) and magnetic field flux guide material 30, the HET 10 produces a predetermined magnetic dipole moment (e.g., measured in Ampere square meter (A-m$^2$)), which may now be referred to herein as the HET magnetic dipole moment. For example, the HET magnetic dipole moment may be between 2.5 A-m$^2$ and 4.5 A-m$^2$ (plus or minus (±)) in the direction of the longitudinal axis A. In some embodiments, the HET magnetic dipole moment is about 3.5 A-m$^2$ (±). This moment may interact with other magnetic fields generated from other sources to produce a torque on the HET, and ultimately on a spacecraft on which the HET 10 is mounted. Other magnetic fields may include, for example, Earth's magnetic field, magnetic fields produced by other components on the spacecraft, etc. For example, when the spacecraft is flying in low Earth orbit, Earth's magnetic field may interact strongly with the magnetic field of the HET 10, thereby applying a significant torque to the spacecraft.

In addition, the magnetic field (magnetic dipole moment) of the HET 10 may be represented by a plurality of flux lines extending relative to the longitudinal axis A through the first and second ends 28, 24, respectively, of the HET 10. The flux lines (not shown) define an overall shape of the HET magnetic field. The flux lines can be affected by other magnetic fields generated from external magnetic sources proximate the HET 10.

The use of nulling magnets, shielding, or a combination of both in the HET 10 may reduce or achieve a near-zero net magnetic dipole moment of the HET 10 itself (e.g., ±0.5 A-m$^2$) without affecting the actual magnetic circuit 56 of the magnetic field sources 40A, 40B and magnetic field flux guide material 30, thereby reducing the torque applied to the spacecraft by the other magnetic fields. For example, in some embodiments, the nulling magnets produce a compensating magnetic dipole moment, and a combination of the HET magnetic dipole moment and the compensating magnetic dipole moment results in a net magnetic dipole moment of the entire system of the HET 10. In other embodiments, the shielding or a combination of the nulling magnets and shielding inhibit or prevent the HET magnetic dipole moment from interacting with other magnetic dipole moments outside of the HET 10. Accordingly, the nulling magnets, shielding, or a combination of both in the HET 10 reduce an absolute value of the HET magnetic dipole moment in a direction along the longitudinal axis A. Furthermore, the nulling magnets, shielding, or a combination of both, may be positioned relative to the HET 10 to minimize or reduce the effect of the magnetic fields generated from the other sources on the overall shape of the magnetic field of the HET 10 proximate the first end 28 of the HET 10.

Figure 3:
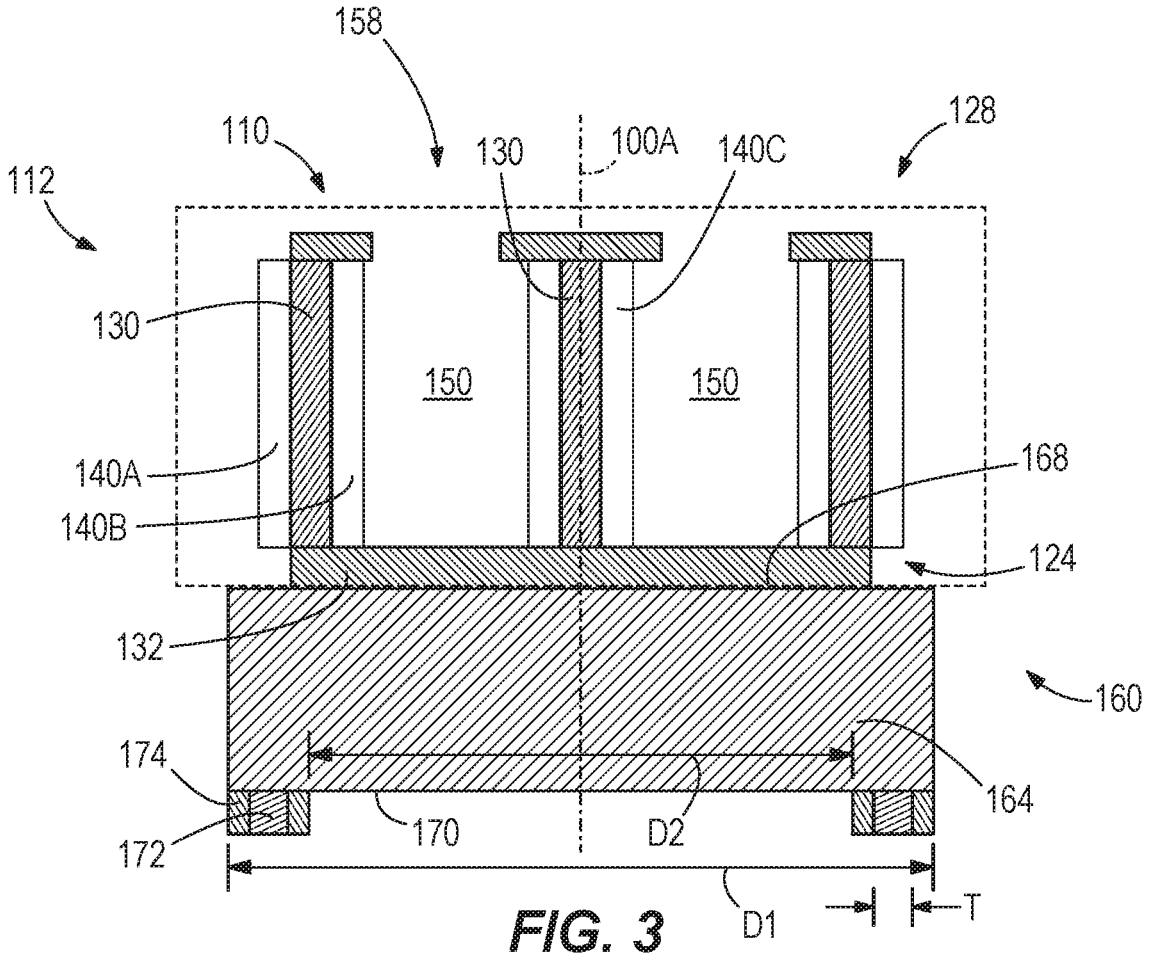
FIG. 3 is a longitudinal schematic cross-sectional view of a HET assembly in accordance with the disclosure.

FIG. 3 illustrates schematically an assembly 112 of a first HET 110 embodying the present disclosure, and like elements have been given the same reference numbers plus 100. The assembly 112 includes a mount assembly 160 and the HET 110. The HET 110 includes magnetic field sources 140A-140C, magnetic field flux guide material 130, plate 132, and a discharge chamber 150 defining a longitudinal axis 100A. A discharge area 158 of the HET 110 is positioned proximate a first end 128 of the HET 110.

The mount assembly 160 includes a body 164 couplable to the HET 110. More specifically, the body 164 includes a first side 168 and a second side 170 spaced from the first side 168. A second end 124 of the HET 110 opposite the first end 128 is coupled to the first side 168 of the body 164. The mount assembly 160 is formed of non-magnetic material (e.g., aluminum). The mount assembly 160 is configured to support the HET 110 and is configured to securably retain the HET 110 to the spacecraft.

The mount assembly 160 includes a plurality of magnetic elements 172 (e.g., electromagnetic coils or permanent magnets) and a structure 174 configured to receive or contain the magnetic elements 172. In the illustrated embodiment, the plurality of magnetic elements 172 includes one element 172 positioned on the second side 170 of the body 164. The illustrated element 172 in one embodiment is a single, toroidal magnet radially spaced from the longitudinal axis 100A. In other embodiments, the plurality of magnetic elements 172 may be one or more discrete magnets positioned relative to the longitudinal axis 100A. These discrete magnetic elements may each be formed by an arc-shaped segment, rod-like shaped segment, box-like shaped segment, etc. Still further, the magnetic elements 172 may be positioned at select radial positions relative to the longitudinal axis 100A.

In the illustrated embodiment, the structure 174 has a shape matching with or complementary of the magnetic element 172. In particular, the illustrated structure 174 has a cylindrical shape with an outer diameter D1 and an inner diameter D2. The outer diameter D1 and the inner diameter D2 may be selected based on a diameter of the magnetic element 172. Additionally, the radial position of the magnetic element 172 relative to the longitudinal axis 100A is based on the diameter of the magnetic element 172. As such, the diameter may be selected based on positioning the magnetic element 172 radially closer to or farther from the longitudinal axis 100A.

In addition, the magnetic element 172 has a thickness T. The thickness T is the difference between the outer diameter D1 of the structure 174 and the inner diameter D2 of the structure 174. As such, the outer diameter D1 and the inner diameter D2 may also be selected based on the thickness T of the magnetic element 172.

Still further, the plurality of magnetic elements 172 may be one or more permanent magnets positioned radially relative to the longitudinal axis 100A. As such, the structure 174 may be configured to retain the one or more permanent magnets.

The plurality of magnetic elements 172 are collectively configured to produce an independent magnetic dipole moment and counteract the HET magnetic dipole moment produced by the magnetic field sources 140A-140C and the magnetic field flux guide material 130, without significantly disrupting the magnetic field within the discharge chamber 150 and the discharge area 158 (i.e., affecting the overall shape of the magnetic field or the orientation of the magnetic field flux lines proximate the first end 128). In particular, the magnitude and direction of the magnetic dipole moment of the magnetic elements 172 is selected for reducing the absolute value of the magnetic dipole moment of the HET 110 by a certain amount, one example of which may be a predetermined percentage (%) in a direction along the longitudinal axis 100A, which in some applications may result in a near-zero net magnetic dipole moment (A-m$^2$) for the system. In other embodiments, the absolute value of the magnetic dipole moment of the HET 110 may be reduced by a set numerical value (e.g., value having unit A-m$^2$). Accordingly, the plurality of magnetic elements 172 may be referred to as null magnetic elements 172 or compensating elements 172 configured to compensate for the HET magnetic dipole moment of the HET 110. The magnetic dipole moment of the magnetic elements 172 may be based on one or more of the following: the type of magnetic elements 172, the number of magnetic elements 172, the size (e.g., diameter, thickness) of the magnetic elements 172, and/or the radial position of the magnetic element 172 relative to the longitudinal axis 100A. The magnetic elements 172 produce the compensating magnetic dipole moment.

In some embodiments, the plurality of magnetic elements 172 is configured to reduce the HET magnetic dipole moment of the HET 110 by between forty and ninety-five percent. In other embodiments, the plurality of magnetic elements 172 is configured to reduce the HET magnetic dipole moment of the HET 110 by between fifty and ninety-five percent. In yet other embodiments, the plurality of magnetic elements 172 is configured to reduce the HET magnetic dipole moment of the HET 110 by between sixty and ninety-five percent. In yet still other embodiments, the plurality of magnetic elements 172 is configured to reduce the HET magnetic dipole moment of the HET 110 by between seventy and ninety-five percent. For example, in the illustrated embodiment, the magnetic element 172 is configured to reduce the HET magnetic dipole moment of the HET 110 from about 3.5 A-m$^2$ (±) to about 0.4 A-m$^2$ (±) such that the HET magnetic dipole moment is reduced by about ninety percent.

Figure 4:
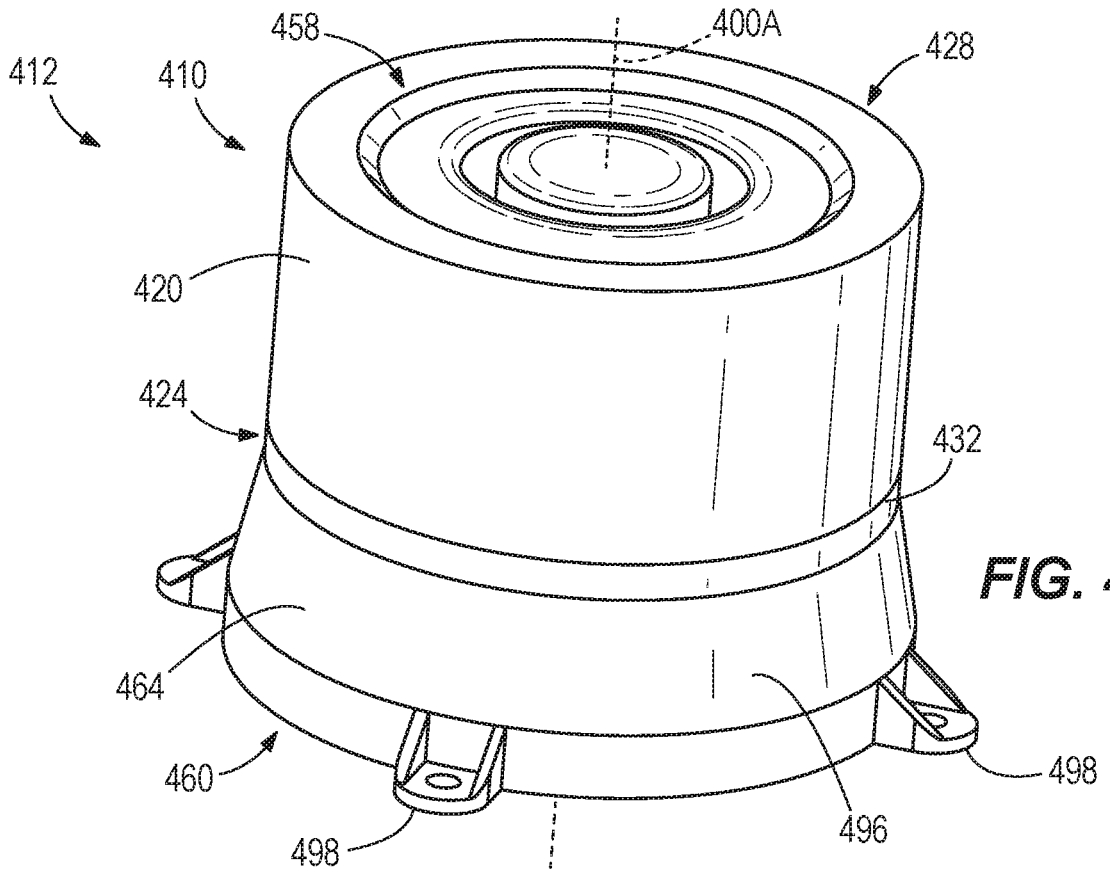
FIG. 4 is a perspective view of another HET assembly in accordance with the disclosure, illustrating a mount assembly of the HET.
Figure 5:
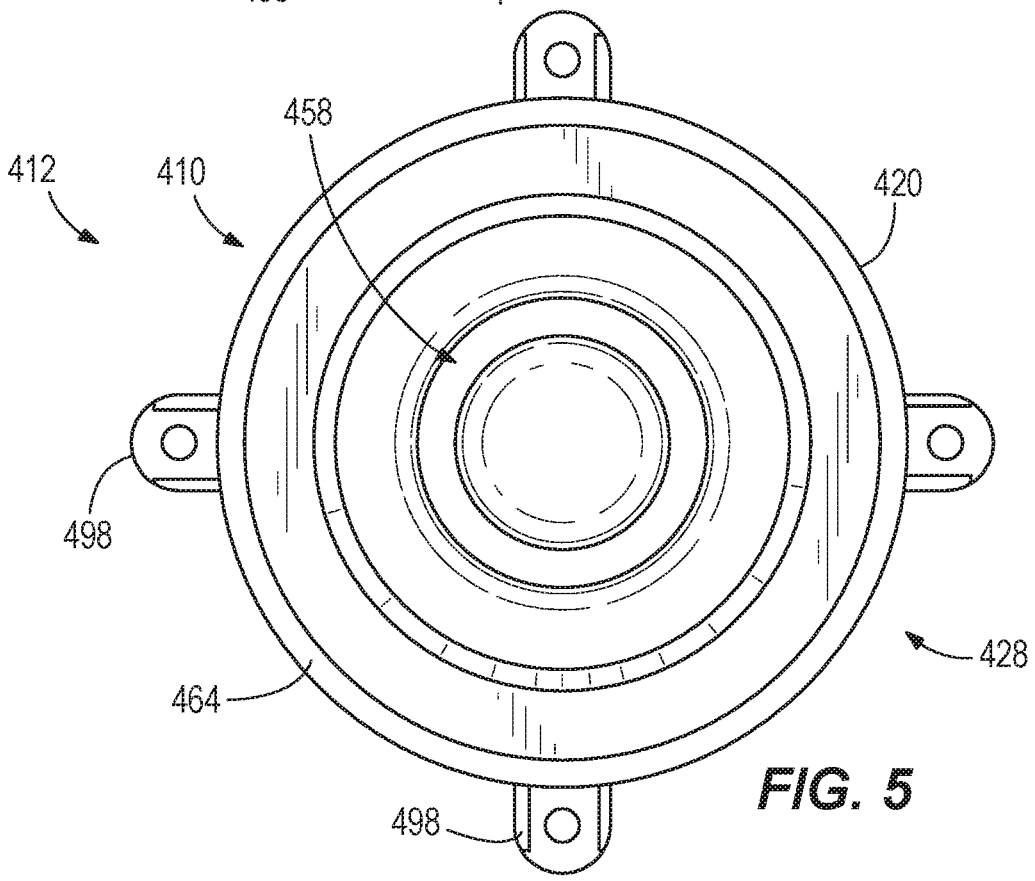
FIG. 5 is a top view of the HET assembly of FIG. 4.

FIGS. 4-7 illustrate one example of an assembly 412 of the first HET 110 or portions thereof embodying the present disclosure, and like elements have been given the same reference numbers as the HET assembly 112 plus 300. The assembly 412 includes a mount assembly 460 and the HET 410. The HET 410 includes magnetic field sources, magnetic field flux guide material, and a discharge chamber (not shown; but see magnetic field sources 140A-140C, magnetic field flux guide material 130, and discharge chamber 150 of the HET 110 of FIGS. 1-2) at least partially positioned within a housing 420. The illustrated HET 410 also includes a plate 432. The HET 410 includes the housing 420, which as illustrated in FIG. 4 has a cylindrical shape. The HET 410 defines a longitudinal axis 400A. A discharge area 458 of the HET 410 is positioned proximate a first end 428 of the HET 410.

The mount assembly 460 is adjacent to the housing 420. The mount assembly 460 includes a body 464. The illustrated body 464 is positioned proximate a second end 424 of the HET 410, opposite the first end 428. In the illustrated embodiment, the body 464 is coupled directly or indirectly to the plate 432 of the HET 410 (e.g., such as by fasteners). For example, the plate 432 or the body 464 includes a plurality of apertures, each aperture configured to receive a respective bolt for coupling the plate 432 and the body 464 together. In other embodiments, the body 464 may be coupled to the HET 410 by other securement means such as welding, and/or may be coupled at other locations of the HET 410 (e.g., magnetic flux guide material, magnetic field sources, etc.). Accordingly, the second end 424 of the HET 410 is coupled to a first side 468 of the body 464.

Figure 6:
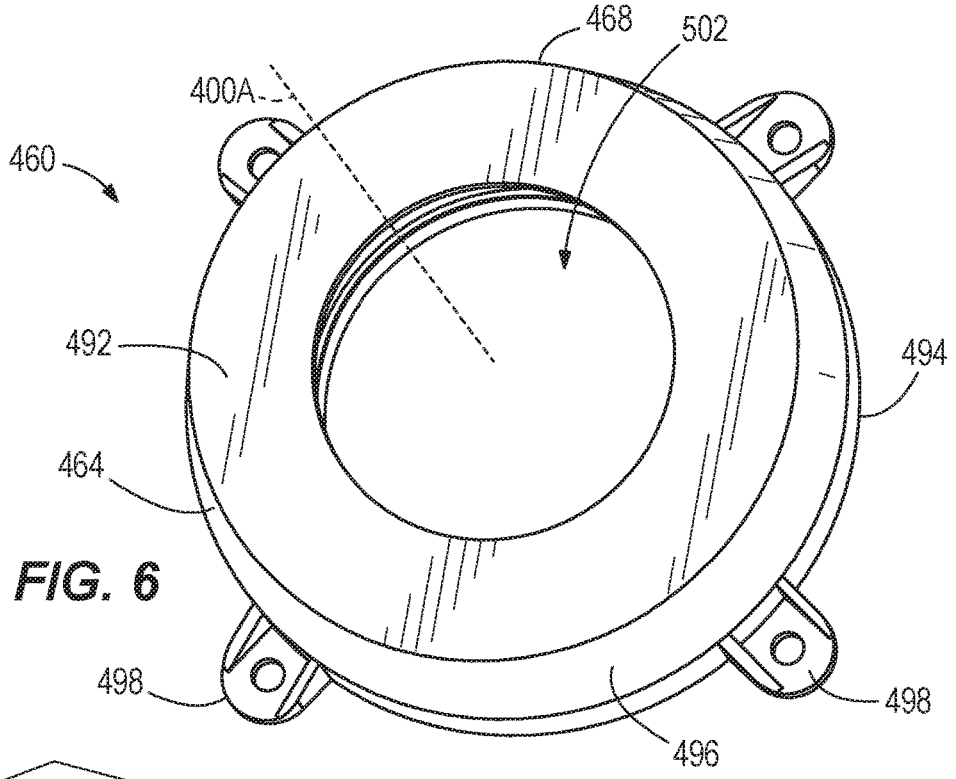
FIG. 6 is a top perspective view of the mount assembly only of the HET assembly of FIG. 4.
Figure 7:
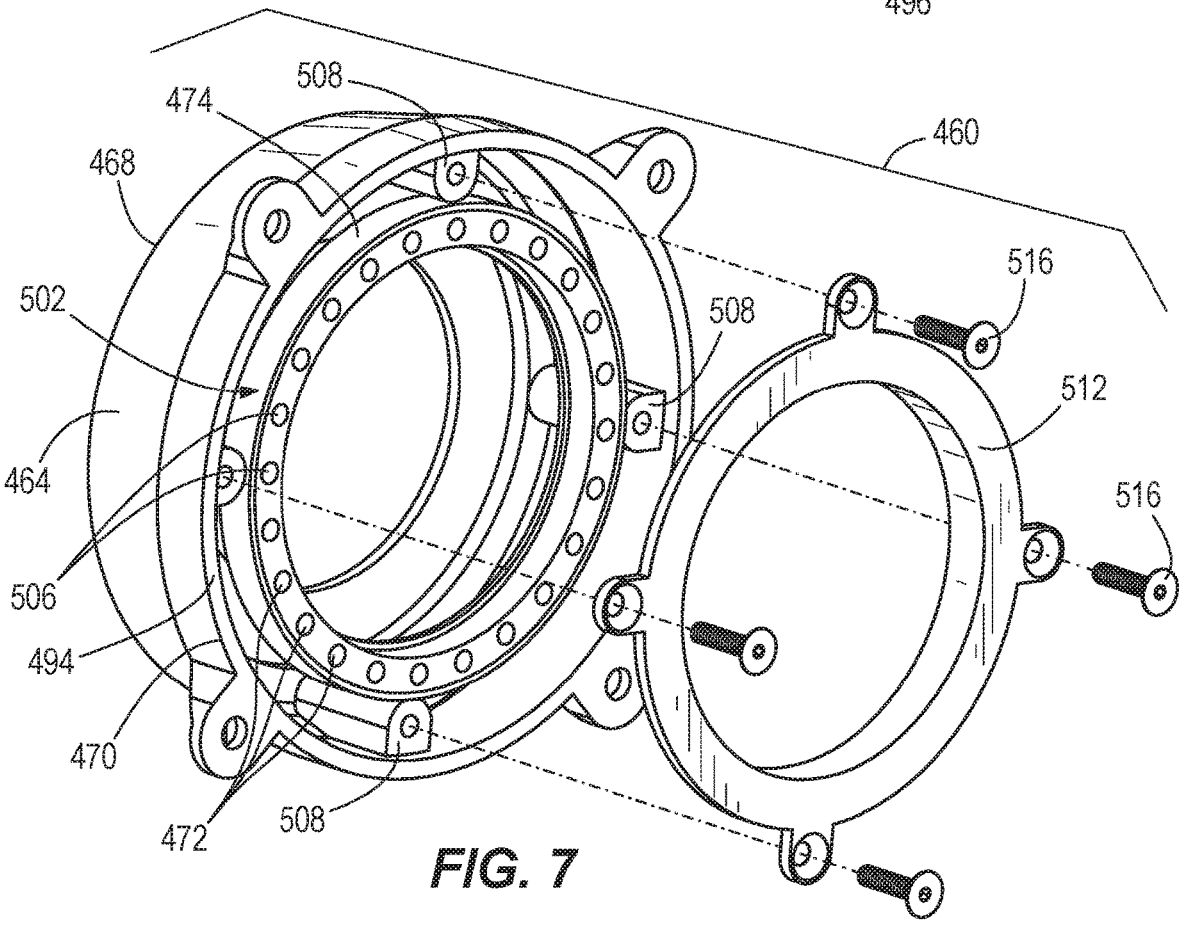
FIG. 7 is an exploded view of the mount assembly of FIG. 6, illustrating a position of a structure configured to support a null magnet.

With particular reference to FIGS. 6-7, the body 464 includes a first surface 492 defining the first side 468. A second annular surface 494 at a second side 470 of the body 464 opposite the first side 468 faces away from the magnetic field sources and the magnetic field flux guide material. Furthermore, the illustrated body 464 has a generally annular shape formed by a circumferential surface 496 extending from the first side 468 to the second side 470. In other words, the body 464 has a frustoconical shape.

The mount assembly 460 (i.e., the body 464) is formed of non-magnetic material (e.g., aluminum). In addition, the mount assembly 460 is configured to support the HET 410 and is configured to securably retain the HET 410 to the spacecraft. The body 464 further includes a plurality of protrusions 498 extending away from the circumferential surface 496 proximate the second surface 494. The protrusions 498 are configured to securably retain the HET 410 to the spacecraft. In the illustrated embodiment, the protrusions 498 are integral with the body 464; however, in other embodiments, the protrusions 498 may be separate but secured to the body 464. Still further, in other embodiments, the mount assembly 460 may include other structure that support the protrusions 498 or replace the protrusions 498 (e.g., mounting ring, brackets, etc.) for securably retaining the HET 410 to the spacecraft.

With particular reference to FIG. 7, the body 464 includes a cavity 502 defined radially inward of the circumferential surface 496 and between the first and second sides 468, 470, respectively. The body 464 further includes a receptacle 474 positioned within the cavity 502 and configured to retain a plurality of magnetic elements 472. In the illustrated embodiment, the mount assembly 460 includes twenty-four discrete magnets 472 positioned equidistantly and circumferentially about the longitudinal axis 400A. Each magnet 472 is received within a respective aperture 506 defined by the receptacle 474. Alternatively, the plurality of magnetic elements 472 may be one discrete magnet, or one or more electromagnetic coils.

As shown in FIG. 7, in the illustrated embodiment, the mount assembly 460 further includes a plurality of projections 508 and a retaining member 512 (e.g., plate). The projections 508 extend inwardly from the circumferential surface 496. The retaining member 512 is coupled to the projections 508 by fasteners 516. The illustrated projections 508 are axially recessed within the cavity 502 relative to the longitudinal axis 400A. The retaining member 512 is positioned proximate the second side 470 and configured to retain the plurality of magnets 472 and the receptacle 474 within the cavity 502. More specifically, in the illustrated embodiment, the plurality of magnets 472 and the receptacle 474 are supported by the retaining member 512 proximate the second side 470 of the body 464. As such, the magnets 472/receptacle 474 are/is supported by the body 464/retaining member 512.

As discussed with respect to the assembly of the first HET 110, the plurality of magnetic elements 472 of the HET 410 is configured to produce the compensating magnetic dipole moment. In particular, the magnitude and direction of the magnetic dipole moment of the magnetic elements 472 is selected for reducing the absolute value of the magnetic dipole moment of the HET 410 by a certain amount, one example of which may be a predetermined percentage (%) in a direction along the longitudinal axis 400A. In other words, the compensating magnetic dipole moment is configured to reduce the HET magnetic dipole moment toward the near-zero net magnetic dipole moment (A-m$^2$). In other embodiments, the absolute value of the magnetic dipole moment of the HET 410 may be reduced by a set numerical value (e.g., value having unit A-m$^2$). The plurality of magnetic elements 472 are configured to counteract the HET magnetic dipole moment produced by the magnetic field sources and the magnetic field flux guide material 430, without significantly affecting the magnetic field within the discharge chamber 450 and the discharge area 458 (i.e., affecting the overall shape of the magnetic field or the orientation of the magnetic field flux lines proximate the first end 428).

In operation, with reference to the embodiments of the first HET 110, and its corresponding example of an HET 410 as shown in FIGS. 3 and 4-7, respectively, the magnetic circuit 56 (i.e., the magnetic field sources 140A-140C and the magnetic field flux guide material 130, 430) generates the HET magnetic dipole moment. The magnetic elements 172 generate a compensating or counteracting magnetic dipole moment, thereby reducing the HET magnetic dipole moment of the HET 110, 410 by the predetermined percentage (%) toward the near-zero net magnetic dipole moment (A-m$^2$).

Figure 8:
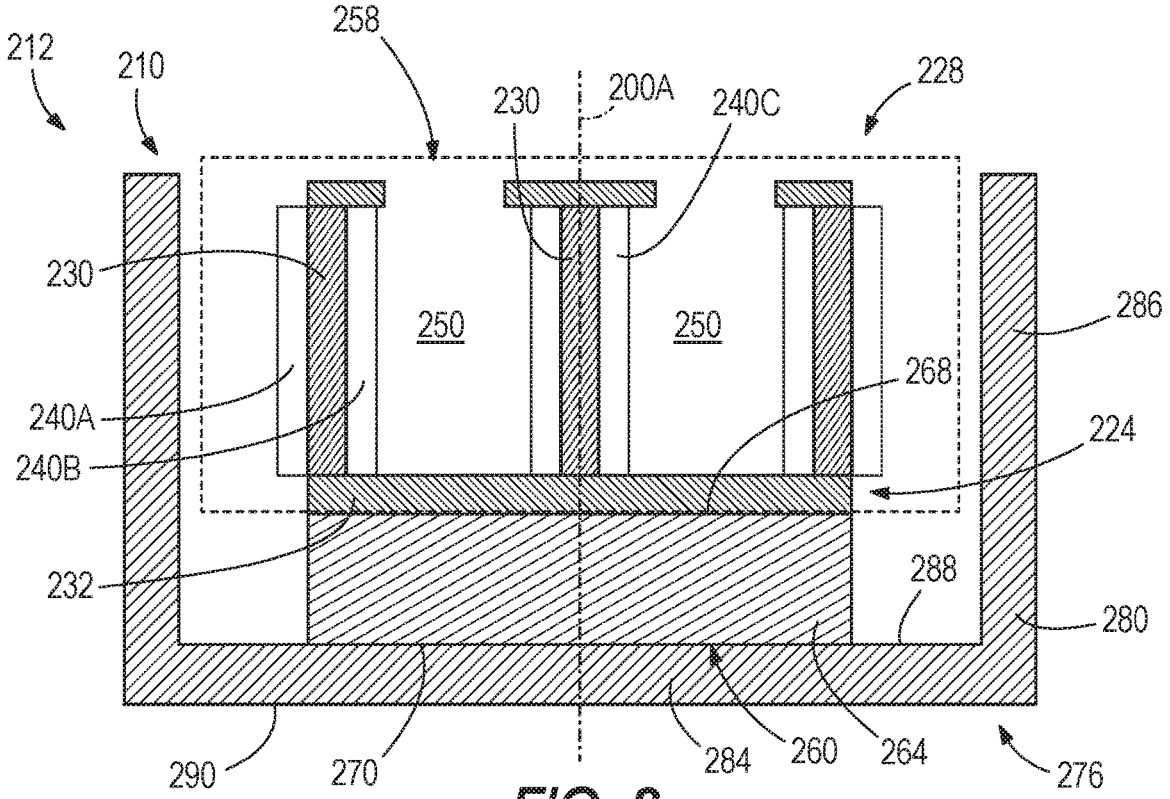
FIG. 8 is a longitudinal schematic cross-sectional view of another HET assembly in accordance with the disclosure.

FIG. 8 illustrates schematically an assembly 212 of a second HET 210 embodying the present disclosure, and like elements have been given the same reference numbers as the HET assembly 112 plus 100. The assembly 212 includes a mount assembly 260 and the HET 210. The HET 210 includes magnetic field sources 240A-240C, magnetic flux guide material 230, plate 232, and a discharge chamber 250 defining a longitudinal axis 200A. A discharge area 258 of the HET 210 is positioned proximate a first end 228 of the HET 210.

The mount assembly 260 includes a body 264 coupable to the magnetic field flux guide material 230/magnetic field sources 240A-240C. More specifically, the body 264 includes a first side 268 and a second side 270 spaced from the first side 268. A second end 224 of the HET 210 opposite the first end 228 is coupled to the first side 268 of the body 264. The mount assembly 260 is formed of non-magnetic material (e.g., aluminum). The mount assembly 260 is configured to support the HET 210 and is configured to securably retain the HET 210 to the spacecraft.

The HET assembly 212 further includes a shield assembly 276. In the illustrated embodiment, the shield assembly 276 includes a housing 280 having a first portion 284 and a second portion 286 extending axially therefrom relative to the longitudinal axis 200A. The first portion 284 has an inner surface 288 in facing relationship with a side 270 of the body 264. The first portion 284 further includes an outer surface 290. The second portion 286 radially surrounds the HET 210 and the mount assembly 260 relative to the longitudinal axis 200A. Although not shown, portions of the mount assembly 260 may extend through the first portion 284 of the housing 280 for coupling the mount assembly 260 to the spacecraft.

The housing 280 is formed by material having high permeability (i.e., soft magnetic material such as iron, ferrite, Mu-metal, Hyperco®, etc.). The housing 280 is configured to shield the magnetic field sources 240A-240C and the magnetic field flux guide material 230 for reducing the absolute value of the HET magnetic dipole moment of the HET 210 by a predetermined percentage (%) in a direction along the longitudinal axis 200A. In other words, the housing 280 is configured to reduce the HET magnetic dipole moment toward the near-zero net magnetic dipole moment (A-m$^2$). More specifically, the housing 280 is configured to inhibit or reduce interaction of the magnetic field generated by the magnetic field sources 240A-240C and the magnetic field flux guide material 230 with other magnetic fields (e.g., Earth's magnetic field) without significantly affecting the magnetic field within the discharge chamber 250 and the discharge area 258 (i.e., affecting the overall shape of the magnetic field or the orientation of the magnetic field flux lines proximate the first end 228). Accordingly, the shield assembly 276 may be referred to as a shield configuration. The shielding capabilities of the shield assembly 276 may be based on one or more of the following: the type of material, the thickness of the first and/or second portions 284, 286, respectively, and/or the radial position of the second portion 286 relative to the longitudinal axis 200A.

In some embodiments, the shield assembly 276 is configured to reduce the HET magnetic dipole moment of the HET 210 by between thirty and seventy percent. In other embodiments, the shield assembly 276 is configured to reduce the HET magnetic dipole moment of the HET 210 by between forty and sixty percent. For example, the shield assembly 276 is configured to reduce the HET magnetic dipole moment of the HET 210 from about 3.5 A-m$^2$ (±) to about 1.9 A-m$^2$ (±) such that the HET magnetic dipole moment is reduced by about fifty percent.

In operation, with reference to FIG. 8, the magnetic circuit 56 generates the HET magnetic dipole moment. The shield assembly 276 shields the HET magnetic dipole moment created by the magnetic circuit 56 (i.e., the magnetic field sources 240A-240C and the magnetic field flux guide material 230), thereby reducing the HET magnetic dipole moment of the HET 210 by the predetermined percentage (%) toward the near-zero net magnetic dipole moment (A-m$^2$).

Figure 9:
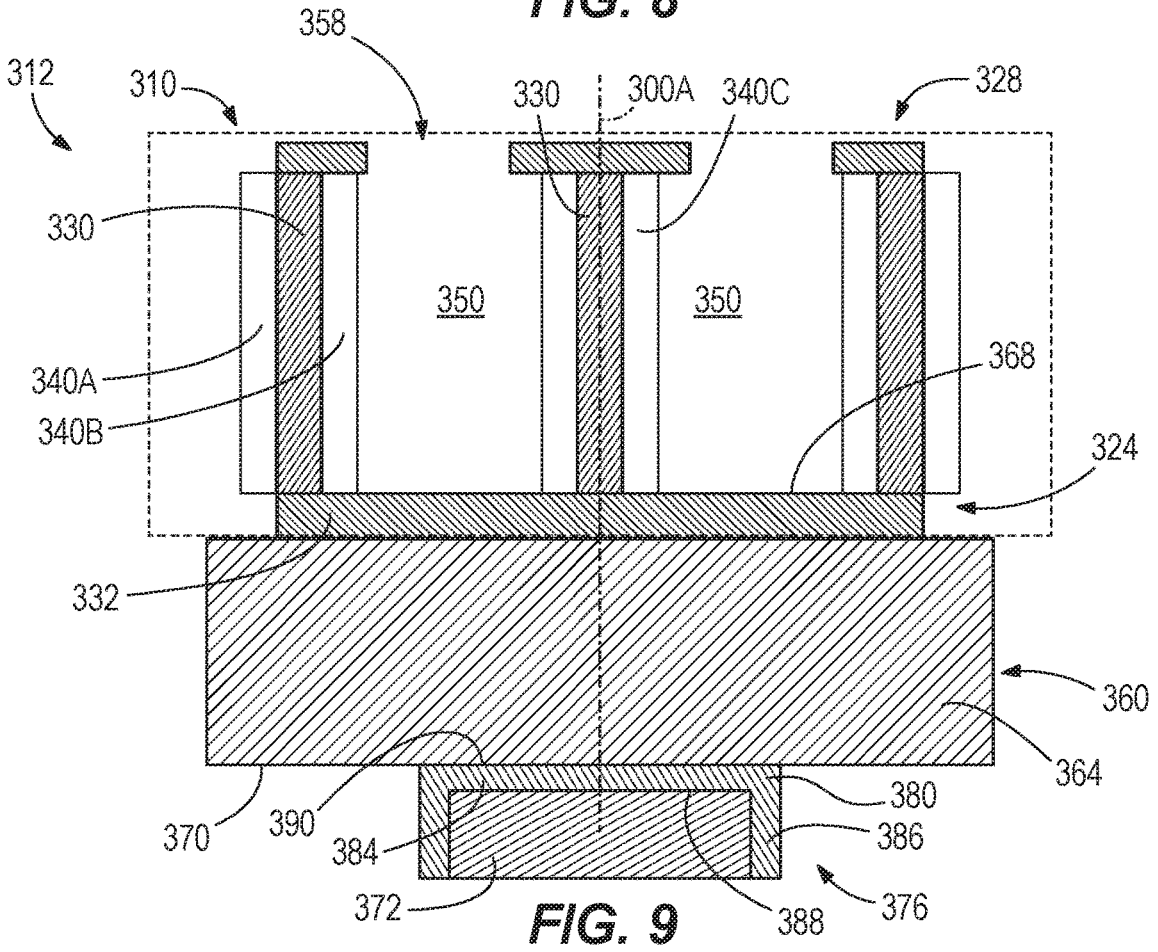
FIG. 9 is a longitudinal schematic cross-sectional view of another HET assembly in accordance with the disclosure.

FIG. 9 illustrates schematically an assembly 312 of a third HET 310 embodying the present disclosure, and includes a combination of the magnetic elements 172 from the first HET assembly 112 and the shield assembly 276 from the second HET assembly 212. Like elements as the first HET assembly 112 have been given the same reference numbers plus 200, and like elements as the second HET assembly 212 have been given the same reference numbers plus 100. The assembly 312 includes a mount assembly 360 and the HET 310. The HET 310 includes magnetic field sources 340A-340C, magnetic field flux guide material 330, plate 332, and a discharge chamber 350 defining a longitudinal axis 300A. A discharge area 358 of the HET 310 is positioned proximate a first end 328 of the HET 310.

The mount assembly 360 includes a body 364 coupable to the magnetic field flux guide material 330/magnetic field sources 340A-340C. More specifically, the body 364 includes a first side 368 and a second side 370 spaced from the first side 368. A second end 324 of the HET 310 opposite the first end 328 is coupled to the first side 368 of the body 364. The mount assembly 360 is formed of non-magnetic material (e.g., aluminum). The mount assembly 360 is configured to support the HET 310 and is configured to securably retain the HET 310 to the spacecraft.

The mount assembly 360 includes a plurality of magnetic elements 372 (e.g., electromagnetic coils or permanent magnets). In the illustrated embodiment, the plurality of magnetic elements 372 includes one element 372 positioned proximate and spaced from the second side 370 of the body 364. The element 372 is a single, cylindrical magnet positioned concentrically with the longitudinal axis 300A. In other embodiments, the plurality of magnetic elements 372 may be one or more discrete magnets positioned at a selected radial location relative to the longitudinal axis 300A. These discrete magnetic elements may each be formed by an arc-shaped segment, rod-like shaped segment, box-like shaped segment, etc., positioned at predetermined radial positions relative to the longitudinal axis 300A. Still further, the plurality of magnetic elements 372 may be one or more electromagnetic coils positioned radially relative to the longitudinal axis 300A. The plurality of magnetic elements 372 is configured to produce a magnetic dipole moment.

The HET assembly 312 further includes a shield assembly 376. In the illustrated embodiment, the shield assembly 376 includes a housing 380 having a first portion 384 and a second portion 386 extending axially therefrom relative to the longitudinal axis 300A. The first portion 384 defines an inner surface 388 in facing relationship with the magnetic element 372. The first portion 384 further includes an outer surface 390 in facing relationship with the second side 370 of the body 364. The second portion 386 radially surrounds the magnetic element 372 relative to the longitudinal axis 300A. Although not shown, portions of the mount assembly 360 may extend around or through the shield assembly 376 for coupling the mount assembly 360 to the spacecraft.

The housing 380 is formed by material having high permeability (i.e., soft magnetic material such as iron, Mu-metal, Hyperco®, etc.). The magnitude and direction of the magnetic dipole moment of the plurality of magnetic elements 372 is selected for reducing the absolute value of the magnetic dipole moment of the HET 310 by a certain amount, one example of which may be a predetermined percentage (%), in a direction along the longitudinal axis 300A. In other embodiments, the absolute value of the magnetic dipole moment of the HET 310 may be reduced by a numerical value (e.g., value having units A-m$^2$). Accordingly, the plurality of magnetic elements 372 may be referred to as null magnetic elements 372 or compensating elements 372 configured to compensate for the HET magnetic dipole moment of the HET 310. The housing 380 is configured to shield the HET 310 from the magnetic element 372 for reducing or constraining the effect of the compensating elements 372 on the magnetic field (i.e., the flux lines) proximate the first end 328 while facilitating the reduction of the absolute value of the HET magnetic dipole moment of the HET 310 by a predetermined percentage (%) in a direction along the longitudinal axis 300A. In other words, the compensating magnetic elements 372 are configured to reduce the HET magnetic dipole moment toward the near-zero net magnetic dipole moment (A-m$^2$), while the housing 380 is configured to reduce or constrain the effect of the compensating magnetic elements 372 on the magnetic field of the HET 310 proximate the first end 328. The combination of the plurality of magnetic elements 372 and the shield assembly 376 is configured to counteract the HET magnetic dipole moment produced by the magnetic field sources 340A-340C and the magnetic field flux guide material 330, without significantly affecting the magnetic field within the discharge chamber 350 and the discharge area 358 (i.e., affecting the overall shape of the magnetic field or the orientation of the magnetic field flux lines proximate the first end 328).

In some embodiments, the plurality of magnetic elements 372/shield assembly 376 is configured to reduce the HET magnetic dipole moment of the HET 310 by between forty and ninety-nine percent. In other embodiments, the plurality of magnetic elements 372/shield assembly 376 is configured to reduce the HET magnetic dipole moment of the HET 310 by between fifty and ninety-nine percent. In yet other embodiments, the plurality of magnetic elements 372/shield assembly 376 is configured to reduce the HET magnetic dipole moment of the HET 310 by between sixty and ninety-nine percent. In yet still other embodiments, the plurality of magnetic elements 372/shield assembly 376 is configured to reduce the HET magnetic dipole moment of the HET 310 by between seventy and ninety-nine percent. For example, the magnetic elements 372/shield assembly 376 is configured to reduce the HET magnetic dipole moment of the HET 310 from about 3.5 A-m$^2$ (±) to about 0.0156 A-m$^2$ (±) such that the HET magnetic dipole moment is reduced by about ninety-eight percent.

In operation, with reference to FIG. 9, the magnetic circuit 56 generates the HET magnetic dipole moment. The shield assembly 376 shields the HET magnetic dipole moment created by the magnetic elements 372, thereby reducing the HET magnetic dipole moment of the HET 310 by the predetermined percentage (%) toward the near-zero net magnetic dipole moment (A-m$^2$).

Thus, the disclosure provides, among other things, an HET assembly 112, 212, 312, 412 configured to have a near-zero net magnetic dipole moment without significantly affecting the magnetic field within a discharge chamber 150, 250, 350, 450 and the discharge area 158, 258, 358, 458, respectively. Specifically, the HET assembly 112, 212, 312, 412 includes compensating elements 172, 372 and/or a shield assembly 276, 376 for achieving the near-zero net magnetic dipole moment. The compensating elements 172, 372 and/or the shield assembly 276, 376 may reduce or inhibit the interaction between the HET magnetic dipole moment of the HET 110, 210, 310, 410 and magnetic dipole moments generated by other magnetic fields such that torque applied to a spacecraft may be lowered.

Although the disclosure has been described in detail with reference to certain preferred embodiments, variations and modifications exist within the scope and spirit of one or more independent aspects of the disclosure as described.

Various features of the disclosure are set forth in the following claims.

What is claimed is:

1. A Hall-effect thruster assembly comprising:

a plurality of magnetic sources for creating a magnetic circuit, the plurality of magnetic sources positioned between a first end and a second end of a Hall-effect thruster, the plurality of magnetic sources defining a longitudinal axis extending through the first end and the second end, the first end configured as a discharge end;

a mount assembly including a body extending between a first side and a second side, the first side coupled to the second end of the Hall-effect thruster, the body defining a cavity, the mount assembly further including a receptacle positioned within the cavity, the mount assembly further configured to secure the plurality of magnetic sources to a spacecraft; and a plurality of discrete magnets retained at least partially within the receptacle, the plurality of discrete magnets positioned closer to the second side than to the first side of the body, wherein the plurality of discrete magnets is positioned relative to the plurality of magnetic sources by the mount assembly such that during operation of the Hall-effect thruster, the plurality of discrete magnets is configured to reduce an absolute value of a magnetic dipole moment created by the magnetic circuit.

2. The Hall-effect thruster assembly of claim 1, wherein the plurality of magnetic sources includes a plate positioned at the second end, wherein the first side of the body is coupled to the plate.

3. The Hall-effect thruster assembly of claim 1, further comprising a housing configured to receive the plurality of magnetic sources, wherein the body is positioned adjacent the housing.

4. The Hall-effect thruster assembly of claim 1, wherein the body includes a circumferential surface extending between the first side and the second side, and wherein the body has a frustoconical shape.

5. The Hall-effect thruster assembly of claim 1, wherein the body includes a plurality of protrusions, each of which is circumferentially positioned relative to the longitudinal axis at the second side, and wherein the plurality of protrusions is configured for coupling the Hall-effect thruster to the spacecraft.

6. The Hall-effect thruster assembly of claim 1, wherein the receptacle defines a plurality of apertures equally spaced circumferentially relative to the longitudinal axis and relative to each other, wherein each aperture receives one discrete magnet of the plurality of discrete magnets.

7. The Hall-effect thruster assembly of claim 1, wherein the receptacle has an annular shape extending about the longitudinal axis.

8. The Hall-effect thruster assembly of claim 1, wherein the mount assembly includes a plurality of projections, wherein each projection of the plurality of projections extends parallel to the longitudinal axis within the cavity, wherein each projection of the plurality of projections includes an end that is axially recessed relative to the second side.

9. The Hall-effect thruster assembly of claim 8, wherein the mount assembly further includes a retaining member coupled to the end of each projection of the plurality of projections, wherein the retaining member retains the plurality of discrete magnets and the receptacle within the cavity.

10. A Hall-effect thruster assembly comprising:

a plurality of magnetic sources for creating a magnetic circuit, the plurality of magnetic sources positioned between a first end and a second end of a Hall-effect thruster, the plurality of magnetic sources defining a longitudinal axis extending through the first end and the second end, the first end configured as a discharge end;

a mount assembly coupled to the second end, the mount assembly configured to secure the plurality of magnetic sources to a spacecraft; and a magnetic element supported by the mount assembly, the magnetic element positioned relative to the plurality of magnetic sources by the mount assembly, wherein the plurality of magnetic sources is configured such that during operation of the Hall-effect thruster, the magnetic circuit created by the plurality of magnetic sources results in a magnetic dipole moment, and wherein the magnetic element is positioned such that during operation of the Hall-effect thruster, the magnetic element is configured to reduce an absolute value of the magnetic dipole moment by a predetermined percentage in a direction along the longitudinal axis.

11. The Hall-effect thruster assembly of claim 10, wherein the magnetic element is one of a discrete magnet or an electromagnetic coil.

12. The Hall-effect thruster assembly of claim 10, wherein the mount assembly includes a body and a support member coupling the magnetic element to the body, and wherein the support member is configured to axially space the magnetic element from the plurality of magnetic sources relative to the longitudinal axis.

13. The Hall-effect thruster assembly of claim 10, wherein the magnetic element includes two or more discrete magnets, each discrete magnet formed by one selected from the group comprising: an arc-shaped segment, a rod-like segment, or a box-like segment.

14. A Hall-effect thruster assembly comprising:

a plurality of magnetic sources for creating a magnetic circuit, the plurality of magnetic sources positioned between a first end and a second end of a Hall-effect thruster, the plurality of magnetic sources defining a longitudinal axis extending through the first end and the second end, the first end configured as a discharge end;

a mount assembly coupled to the second end, the mount assembly configured to secure the plurality of magnetic sources to a spacecraft; and a magnetic element supported by the mount assembly, the magnetic element positioned relative to the plurality of magnetic sources by the mount assembly such that during operation of the Hall-effect thruster, the magnetic element produces a compensating magnetic dipole moment cooperative with the magnetic dipole moment of the Hall-effect thruster to reduce the absolute value of the magnetic dipole moment of the Hall-effect thruster in the direction along the longitudinal axis.

* * * * *